United States Patent [19]

Tatsumi et al.

[11] 4,277,549

[45] Jul. 7, 1981

[54] COPY IMAGE ADJUSTMENT METHOD

[75] Inventors: Susumu Tatsumi, Hino; Tadahiro Eda, Narashino; Chikara Imai, Tokyo, all of Japan

[73] Assignee: Ricoh Company, Ltd., Japan

[21] Appl. No.: 30,896

[22] Filed: Apr. 17, 1979

[30] Foreign Application Priority Data

Apr. 26, 1978 [JP] Japan ..... 53-50323

[51] Int. Cl.[3] ..... G03G 13/06

[52] U.S. Cl. ..... 430/30; 427/8; 427/9; 427/10

[58] Field of Search ..... 427/8, 9, 10; 430/30

[56] References Cited

U.S. PATENT DOCUMENTS 3,513,308 5/1970 Tajima et al. ..... 430/30

*Primary Examiner*—James R. Hoffman

*Attorney, Agent, or Firm*—McGlew and Tuttle

[57] ABSTRACT

In an electrophotographic copying machine, the copy image adjustment method for correcting copy image characteristics comprises the steps of measuring copying characteristics by use of a reference original and resetting development characteristics in accordance with the measurement results.

10 Claims, 11 Drawing Figures

COPY IMAGE ADJUSTMENT METHOD

BACKGROUND OF THE INVENTION

The present invention relates to a copy image adjustment method for use in an electrophotographic copying machine.

Methods are known for adjusting copy image. In one of them used on an electrophotographic copying machine without an exposure detection apparatus and an apparatus for detecting the surface potential of a photoconductor (hereinafer referred to as a photoconductor surface potential detector), a service man checks the copying condition of an original and adjusts the image quality by changing some of the conditions of the copying process by a method of trial and error by use of his own judgment or performs a similar adjustment by reference to a trouble shooting manual.

In another method, used on an electrophotographic copying machine without the exposure detection apparatus and the photoconductor surface potential detector, the copying process conditions, such as charging current, exposure lamp voltage, and development bias voltage are reset at their respective initial values by use of a check meter and a copy is made by use of a test chart and the thus-copied image is compared with a reference image density sample. By referring to the results of such comparison, a toner concentration setting value is changed, so that the process conditions are corrected.

In still another method, used on an electrophotographic copying machine with the photoconductor surface potential detector, the development bias voltage is checked by the surface potential detector (Japanese laid-open patent application Sho-51-98035).

According to yet another method, a standard original is copied, and charging, exposure and smearing of the optical system are detected and corrected.

Since, in the first-mentioned method, the copying condition is corrected intuitively without measuring any characteristics of the copying process, the copying process cannot always be adjusted to the same condition as the initial condition, although the copy image can be adjusted apparently satisfactorily to some extent. This makes the copying process unstable and shortens the service maintenance cycle.

In the second method those characteristic values that can be measured easily in general can be well measured practically, but those that cannot be measured easily in general, such as toner concentration, fatigue of developer, brightness of an exposure light source, smearing of an optical system, a charging apparatus and a photoconductor, cannot be measured practically. The adjustment by this method is still insufficient.

For example, when the toner concentration is measured and found to require that its setting value be changed, the toner concentration is so slow in response to such change that the setting value has to be changed gradually while checking 30 copies or so. This takes a lot of time.

In the third method, the development bias voltage is measured by use of the photoconductor surface potential detector, but the development bias voltage can be easily measured by a tester. Thus, the use of the photoconductor surface potential detector is not always advantageous. Furthermore, in this method, only the development bias potential can be checked.

In the fourth method, the conditions of the copying process can be detected and corrected up to the step of a latent electrostatic image formation. However, the conditions of the succeeding processes, particularly, toner concentration and fatigue of developer in the development process, cannot be measured. Accordingly, the toner concentration and development bias voltage cannot be adjusted appropriately, and timing for exchanging the developer cannot be determined by this method.

SUMMARY OF THE INVENTION

It is therefore an object of the present invention to provide a copy image adjustment method comprising the steps of obtaining a copy image from a standard original by use of an electrophotographic copying machine, detecting the image density of the copy image in the course of the copying process, and resetting the development characteristics by detection signals produced when the image density of the copy image is detected.

According to the present invention, the copying process conditions of an electrophotographic copying machine can be correctly adjusted in a short time so as to set the copy image quality at its initial standard. The characteristics of the copying conditions, which cannot be measured easily by a tester, can be measured and reset. Furthermore, exposure detectors and photoconductor surface potential detectors incorporated in the electrophotographic copying machine can be used.

BRIEF DESCRIPTION OF THE DRAWINGS

For a better understanding of the invention as well as the objects and other features thereof, reference will be made to the following detailed description which is to be read in conjunction with the drawings, wherein.

DETAILED DESCRIPTION OF THE PREFERRED EMBODIMENTS

Figure 1:
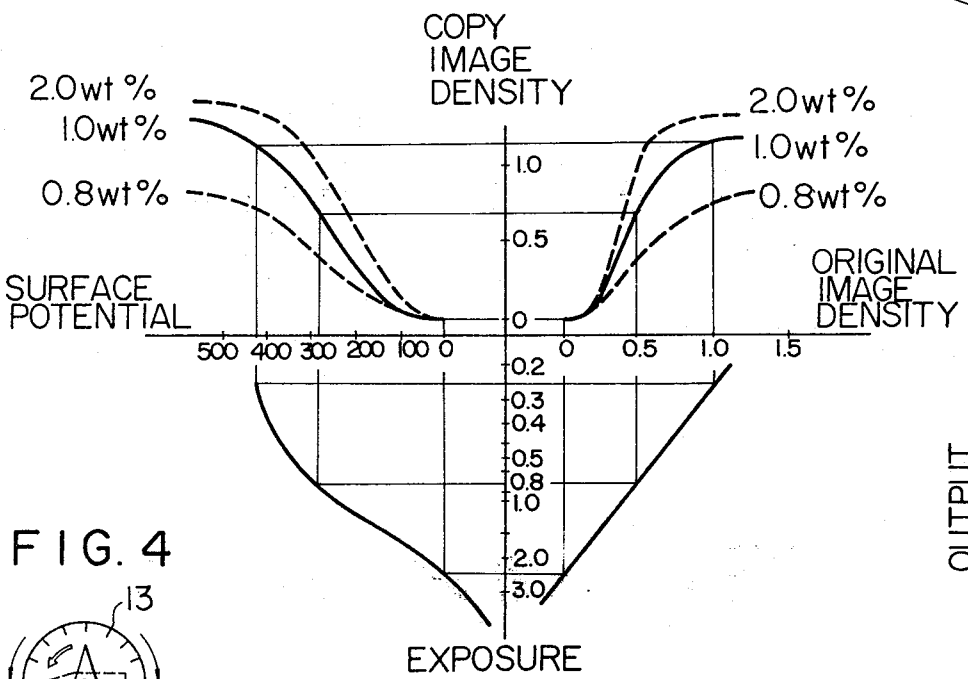
FIG. 1 is a characteristic diagram showing a copying symmetry.

An embodiment of a copy image adjustment method according to the present invention is applied to an electrophotographic copying machine provided with an exposure detector and a photoconductor surface potential detector. In this embodiment, when the copying process conditions in the second, third and fourth quadrants of a copying symmetry shown in FIG. 1 are varied, the difference between the copy image characteristics in the first quadrant and the initially set copy image characteristics is detected and processed by the exposure detectors or by the photoconductor surface potential detectors and the correction values of the copying process conditions are indicated by an output of the processing, so that the copying process conditions are corrected or the copying process conditions are automatically reset, whereby the copying process conditions are corrected to the initial setting values, respecively.

In an electrophotographic copying machine provided with the photoconductor surface potential detector and correction control means for correcting and controlling charging and exposure, namely means for correcting and controlling the characteristics in the third and fourth quadrants, the development function mainly relating to the toner concentration will now be explained. When the toner concentration differs from its set value, the characteristics in the first and second quadrants vary from the solid lines to the dash lines as shown in FIG. 1. Accordingly, when copying is performed by use of a gray scale with different image densities in ranks as a standard original and the image density of a reference gray scale is set so that the image density of copies is the same as that of the reference gray scale and the toner concentration is at a predetermined set value, the image density of the copied gray scale will be higher than that of the reference gray scale when the toner concentration is higher than the set toner concentration.

Figure 2:
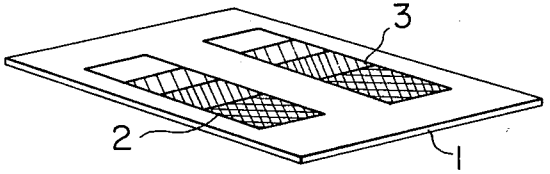
FIG. 2 is a schematic perspective view of a contact glass on which originals are placed in an embodiment according to the present invention.
Figures 3, 5:
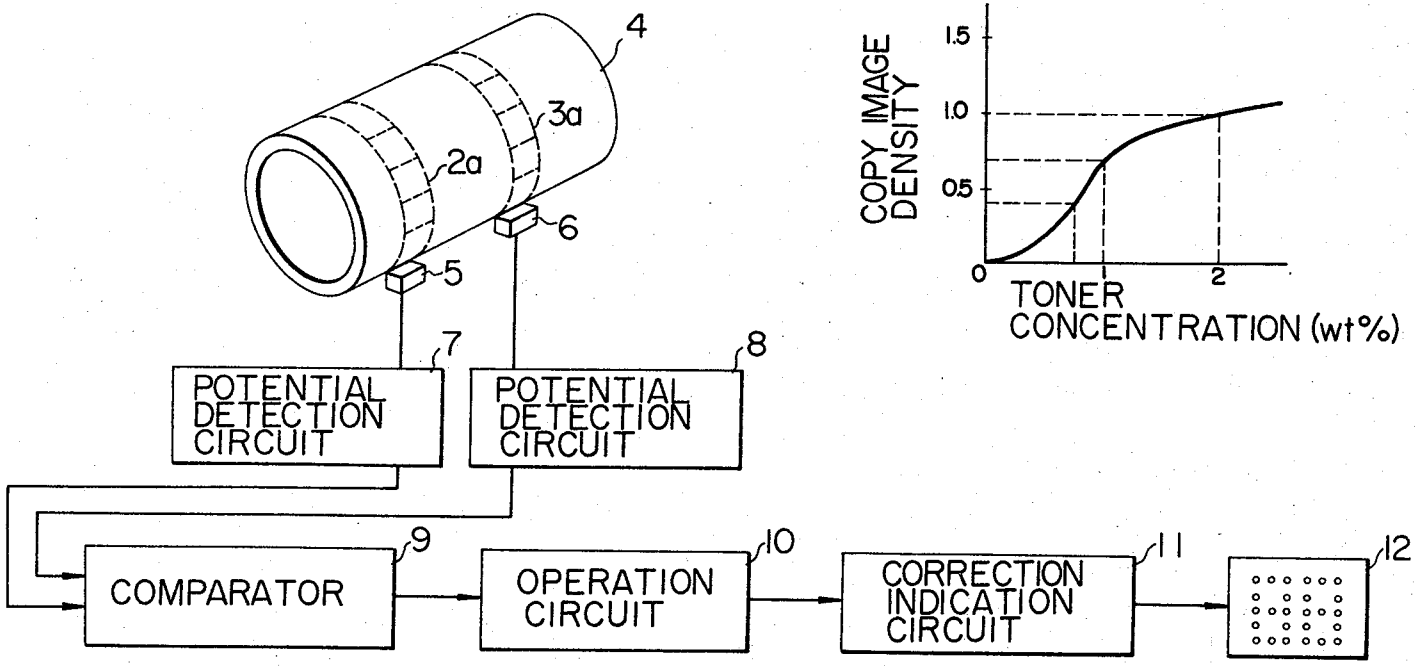
FIG. 3 is a schematic block diagram of part of an embodiment of a copying image adjustment apparatus according to the present invention.
FIGS. 5, 6 and 7 are the characteristic curves for explaining the embodiment of FIG. 3.

Referring to FIGS. 2 and 3a gray scale 2 obtained by copying the standard original placed on a contact glass 1 and a reference gray scale 3 are placed side by side on the contact glass 1 so that copying of the two gray scales 2 and 3 is performed, whereby as shown in FIG. 3, their respective latent electrostatic images 2*a* and 3*a* are formed on a photoconductor 4. The respective potentials of the latent electrostatic images 2*a* and 3*a* are detected by potential detection circuits 7 and 8 employing photoconductor surface potential detectors 5 and 6, so that the optical densities of the two gray scales 2 and 3 are detected in the form of electric potentials. The detected potentials are compared and their difference is determined by a comparator 9. The correction value of the toner concentration is operated by an operation circuit 10 from a output signal produced from the comparator 9. The correction value is indicated by a correction value indicator 12.

Figure 4:
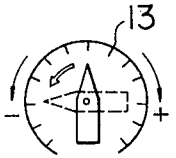
FIG. 4 is a schematic plan view of a toner concentration setting dial of an electrophotographic copying machine for use in the present invention.

FIG. 4 shows a toner concentration setting dial 13 that can be corrected according to the correction value indicator 12, whereby the toner concentration at the development section can be corrected to its original value. In this case, the potential of each of the latent electrostatic images 2*a* and 3*a* can be measured and subjected to operation. On the other hand, when a standard original with 0.5 optical density is employed and the toner concentration is different from its setting value, the copy image density varies as the toner concentration varies as shown in FIG. 5.

Figure 6:
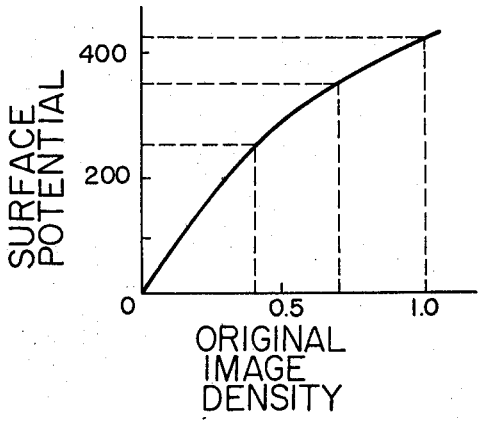

In FIG. 6, thre is shown the surface potential detected by the potential detection circuit 7 when the copied gray scale 2 is copied again.

Figure 7:
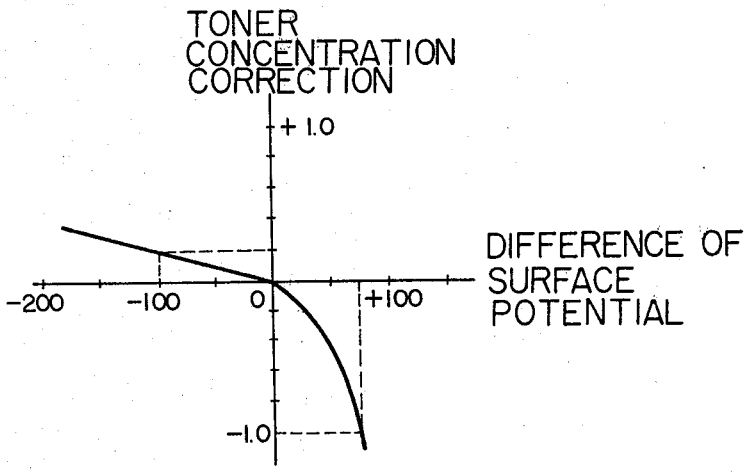

Referring to FIG. 7, the difference between the surface potential detected by the potential detection circuit 7 and the potential detected by the potential detection circuit 8 at the time of copying of the reference gray scale 3 (in this case, the image density is 0.7) is plotted as abscissa and the toner conentration correction value as ordinate. Since the toner concentration correction value is indicated by the correction value indicator 12, the toner concentration in the development section can be corrected to its original value by turning the toner concentration setting dial 13 to the value of the indicated toner concentration.

Figure 8:
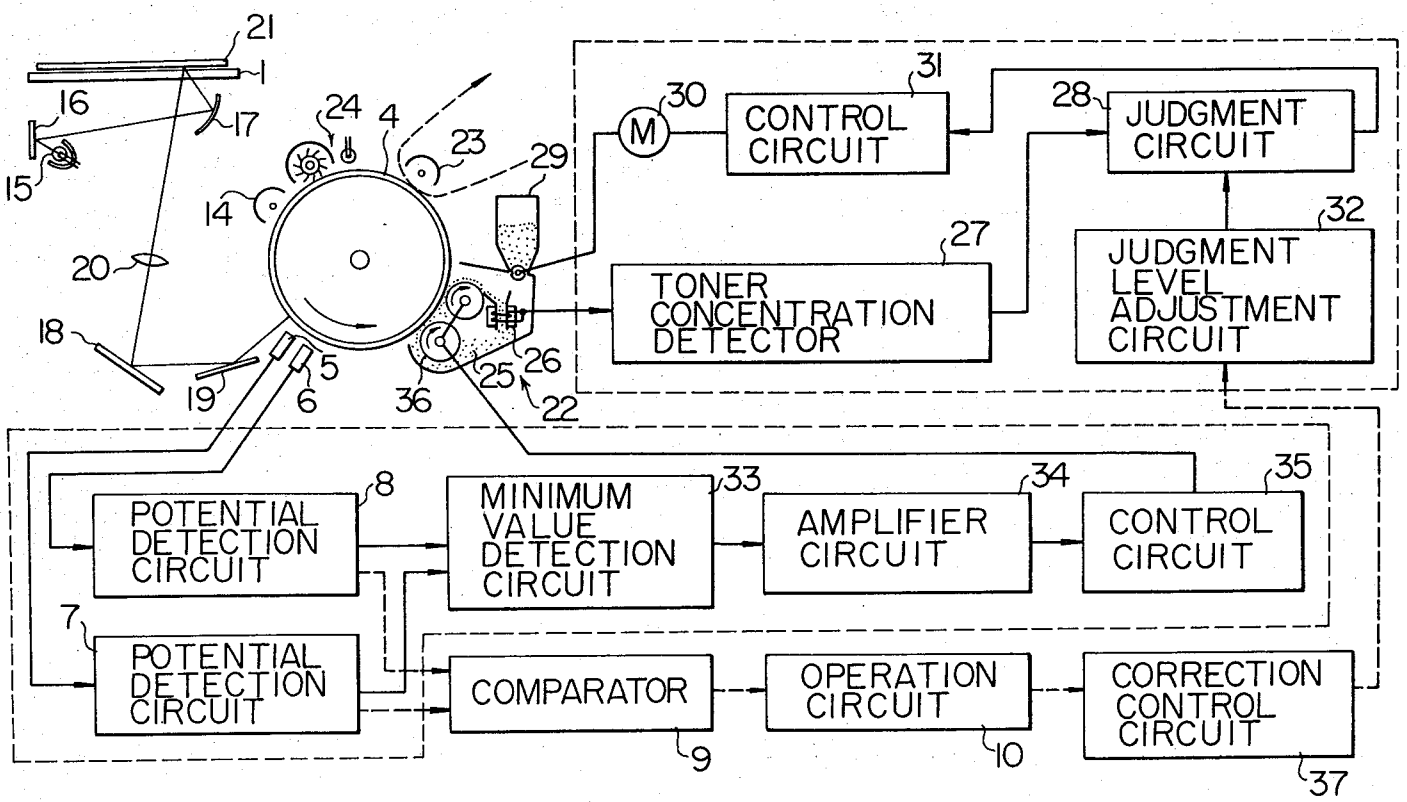
FIG. 8 is a schematic block diagram of another copy image adjustment apparatus for use in the present invention.

Referring to FIG. 8, there is shown another embodiment of a toner concentration correction apparatus capable of correcting toner concentration automatically according to the present invention. In an electrophotographic copying machine in FIG. 8, the photoconductor 4 is rotated and charged uniformly by a charging apparatus 14. The image of an original 21 placed on the contact glass 1 is projected on the photoconductor 4 by an exposure apparatus comprising the contact glass 1, a lamp 15, mirrors 16, 17, 18 and 19, and a lens 20, so that a latent electrostatic image is formed on the photoconductor 4. The latent electrostatic image is developed by a magnetic brush development apparatus 22, and the developed image is then transferred to a transfer sheet fed from a sheet feeding apparatus. The transfer sheet, with toner image fixed thereto by an image fixing apparatus 23, is discharged from the electrophotographic copying machine. On the other hand, the photoconductor 4 is cleaned by a cleaning apparatus 24 and is used again. The toner concentration of a developer 25 held in a development apparatus 22 is detected by a toner concentration detector 27 employing a coil 26, and judgment circuit 28 judges whether the toner concentration is appropriate or not. A toner replenishment apparatus 29 is driven by a motor 30 and replenishes toner to the development apparatus 22, and a control circuit 31 controls the motor 30 in accordance with an output signal from the judgment circuit 28, so that the toner concentration of the developer 25 is controlled to be at a set value. This value is set in accordance with the judgment level of the judgment circuit 28 and the judgment level can be adjusted by a judgment level adjustment circuit 32. On the other hand, the photoconductor surface potential detectors 5 and 6 are disposed between the exposure apparatus and the development apparatus 22 and in close proximity with the photoconductor 4 and are arranged side by side in the axial direction of the photoconductor 4. The potential detection circuits 7 and 8 employing the photoconductor surface potential detectors 5 and 6 respectively detect the surface potential of the photoconductor 4 and a minimum value out of the detection outputs from the potential detection circuits 7 and 8 is detected by a minimum value detection circuit 33 and is then amplified by an amplifier circuit 34. A control circuit 35 applies a development bias voltage in accordance with the output signal of the amplifier circuit 34 to a development sleeve 36 of the development apparatus 22. When the copy image characteristics are adjusted in such an electrophotographic copying machine, a standard original document is copied to obtain the gray scale 2 and the obtained gray scale 2 and the reference gray scale 3 are placed side by side on the contact glass 1 and copied as in the case of the previously mentioned embodiment and the potentials of the latent electrostatic images of the gray scales 2 and 3 on the photoconductor 4 are detected by the potential detection circuits 7 and 8, respectively and are compared by the comparator 9 and by the output of the comparator 9, the correction values are operated by the operation circuit 10. The correction quantity control circuit 37 controls the judgment level adjustment circuit 37 in accordance with the output signal of the operation circuit 10 to adjust the judgment level, changing the toner concentration, whereby the copy image characteristics are corrected.

Figure 9:
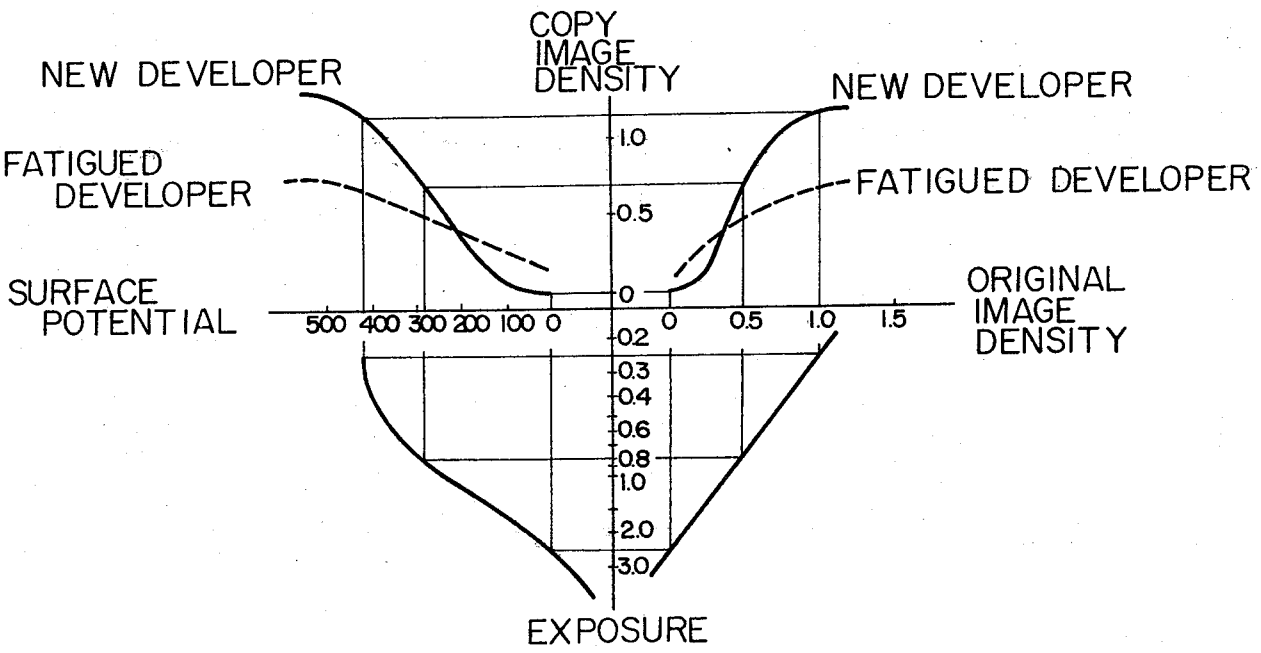
FIG. 9 is a characteristic diagram for explaining the present invention.

The development characteristics in the second quadrant change as shown by the dash line in FIG. 9 as the fatigue of the developer occurs. In other words, when the toner concentration changes, the copy image density wholly increases or decreases as shown in FIG. 1. However, as the developer becomes fatigued, the copy image density corresponding to a high image density portion of the original is decreased, while the copy image portion corresponding to a low image density portion of the original is increased as shown by the dash lines in FIG. 9. Accordingly, by the changing chacteristics of the gray scales 2 and 3, the change of toner concentration and the fatigue of the developer can be separately recognized. Therefore, by detecting the changing characteristics at a plurality of portions of the gray scales 2 and 3 in the above-mentioned manner, it can be recognized to what extent the developer becomes fatigued. When the developer becomes fatigued beyond a certain fatigue level, indication of "replace the developer" can be displayed or the degree of the fatigue of the developer can be indicated by a developer-fatigue meter.

Figure 10:
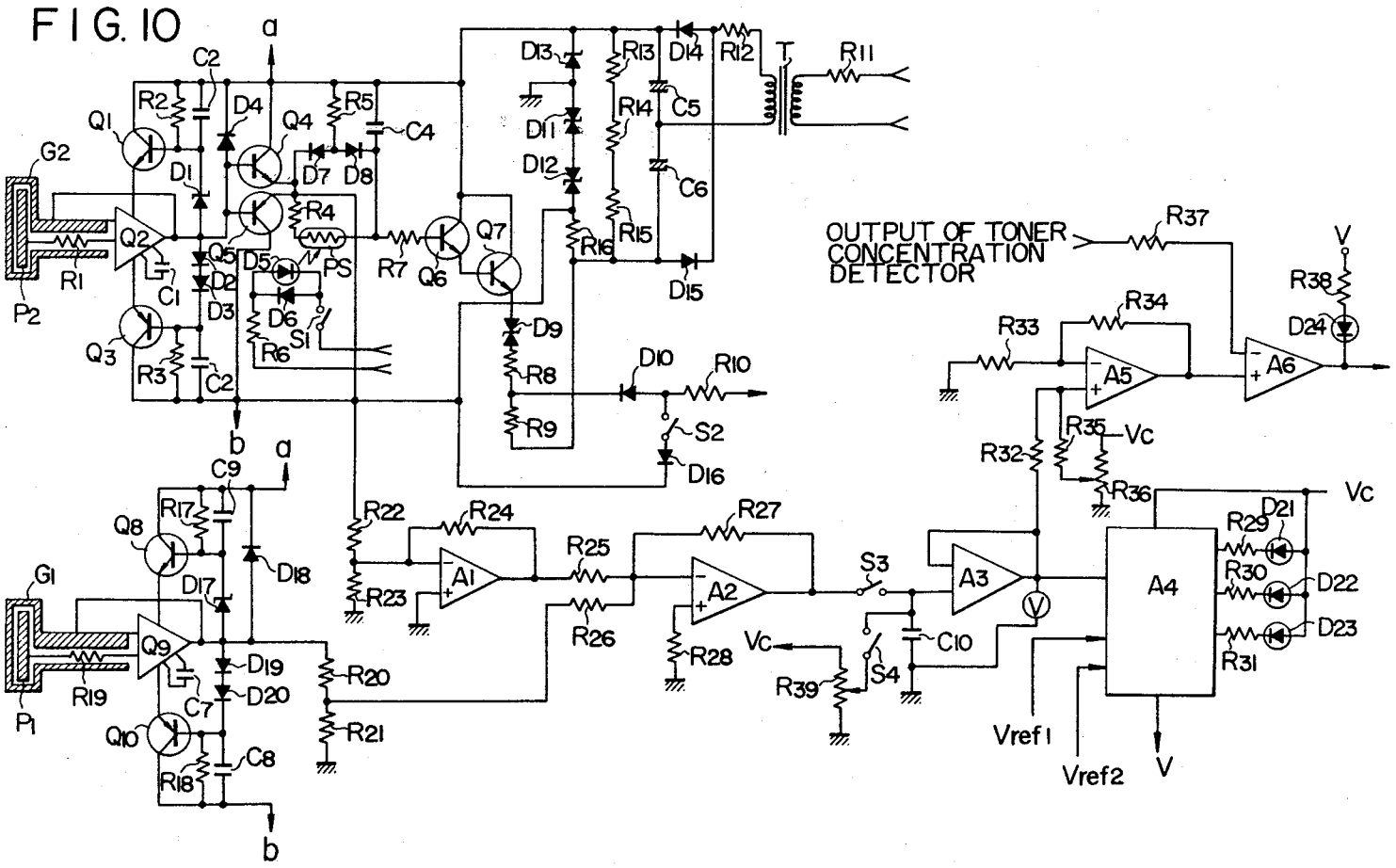
FIG. 10 is a circuit diagram showing part of electric circuits of the copying image adjustment apparatus of FIG. 8.

Referring to FIG. 10, there is shown specifically part of an apparatus shown in FIG. 8. The photoconductor surface potential detectors 5 and 6 comprise respectively detection electrodes $P_1$ and $P_2$ and guard electrodes $G_1$ and $G_2$ disposed around the detection electrodes $P_1$ and $P_2$. The potential detection circuit 8 comprises the photoconductor surface potential detector 6, an amplifier element $Q_2$, transistors $Q_1$, $Q_3$, $Q_4$ and $Q_5$, Zener diode $D_1$, diodes $D_2$–$D_4$, condensers $C_1$–$C_3$, and resistors $R_1$–$R_3$, and the potential of the detection electrode $P_2$ is applied to the guard electrode $G_2$ through the amplifier element $Q_2$. A light emitting diode $D_5$, a light receiving element PS, a switch $S_1$, resistors $R_4$–$R_6$, diodes $D_6$–$D_8$ and condenser $C_4$ constitute a minimum value detection circuit 33. When the leading end portion of a latent electrostatic image on the photoconductor 4 passes through the photoconductor surface potential detector 6, the light emitting diode $D_5$ is lit and the light receiving element PS is turned on, so that the outputs of the transistors $Q_4$ and $Q_5$ are stored in the condenser $C_4$. When the outputs of the transistors $Q_4$ and $Q_5$ are below the outputs that have been stored in the condenser $C_4$, the outputs of the transistors $Q_4$ and $Q_5$ are stored in the condenser $C_4$ through the diodes $D_7$ and $D_8$.

Referring to FIG. 8, the minimum value detection circuit 33 is shown as if the minimum value detection circuit takes the minimum values of the outputs of the potential detection circuits 7 and 8. However, in practice, the minimum value detection circuit 33 takes the minimum value of the potential detection circuit 8. In FIG. 10, the transistors $Q_6$ and $Q_7$, varistor $D_9$, and resistors $R_7$–$R_9$ constitute an amplifier circuit 34. The minimum value of the condenser $C_4$ is amplified by the transistors $Q_6$ and $Q_7$ and subjected to a level shift by the varistor $D_9$ and applied thorugh the diode $D_{10}$ and resistor $R_{10}$ to the development sleeve 36, which serves as a development electrode as well.

Transformer T, condensers $C_5$ and $C_6$, varistors $D_{11}$ and $D_{12}$, Zener diode $D_{13}$, diodes $D_{14}$ and $D_{15}$, and resistors $R_{11}$–$R_{16}$ constitute a power source circuit, which accepts input from an AC power source and transforms the input into a DC voltage and applies the DC voltage to each part of this apparatus. When development of the latent electrostatic image is not performed, a switch $S_2$ is turned on and a predetermined voltage is applied from the power source circuit to the development sleeve 36 through a diode $D_{16}$, the switch $S_2$ and the resistor $R_{10}$.

The potential detection circuit 7 comprises the surface potential detector 5, amplifier element $Q_9$, transistors $Q_8$ and $Q_{10}$, a Zener diode $D_{17}$, diodes $D_{18}$–$D_{20}$, condensers $C_7$–$C_9$, and resistors $R_{17}$–$R_{19}$. The output of the detection electrode $P_1$ is applied to a guard electrode $G_1$ through the amplifier element $Q_9$. The output voltage of the potential detection circuit 7 is divided by resistors $R_{20}$ and $R_{21}$, while the output voltage of the transistors $Q_4$ and $Q_5$ are divided by resistors $R_{22}$ and $R_{23}$ and reversed through an amplifier circuit consisting of reversing amplifiers A and B and a feedback resistor $R_{24}$. The output of the amplifier circuit is added to an output divided by resistors $R_{20}$ and $R_{21}$ through an adder comprising an amplifier $A_2$ and resistors $R_{25}$–$R_{28}$.

The adder and the amplifier circuit constitute a comparator 9. The output of the adder is held in a condenser $C_{10}$ at the timing of detection of a latent image at a certain position on the gray scale through a switch $S_3$ and applied to a wind comparator $A_4$ through an amplifier $A_3$ and then discriminated by reference levels $V_{ref1}$ and $V_{ref2}$, whereby the toner concentration is discriminated into three grades, namely low, medium and high, and by the output of each grade, the light emitting diodes $D_{21}$–$D_{23}$ are actuated through resistors $R_{29}$–$R_{31}$ so that the toner concentration is indicated. An amplifier $A_5$ and resistors $R_{32}$–$R_{36}$ constitute a discrimination level adjustment circuit 32, which generates a discrimination level in accordance with the output of the amplifier $A_3$. An amplifier $A_6$ and a resistor $R_{37}$ constitute a judgment circuit 28 which compares the output of the toner concentration detector 27 with the output of the amplifier $A_5$ and applies the comparison result to the control circuit 31 and also to the light emitting diode $D_{24}$ through a resistor $R_{38}$.

The photoconductor 4 is an organic photoconductor having a negative potential. The outputs $V_{ref}$ and $V_{copy}$ of the photoconductor surface potential detectors 2 and 3 corresponding to the copy gray scale 2 and the reference gray scale 3 are as follows in accordance with the copy image densities.

| Copy Image Density | Low | Same | High |
|---|---|---|---|
| $V_{ref}$ | −400V | −400V | −400V |
| $V_{copy}$ | −300V | −400V | −500V |

Thus, the outputs $V_{ref}$ and $V_{copy}$ are divided into 1/100 by dividers $R_{20}$–$R_{23}$. The output of the dividers $R_{22}$ and $R_{23}$ is reversed by the amplifier $A_1$ and the inputs $V_{ref}$ and $V_{copy}$ of the amplifier $A_2$ are as follows.

| Copy Image Density | Low | Same | High |
|---|---|---|---|
| $V_{ref}$ | +4V | +4V | +4V |
| $V_{copy}$ | −3V | −4V | −5V |

The added outputs when these are added are as follows.

| Copy Image Density | Low | Same | High |
|---|---|---|---|
| Added Output | −1V | 0V | +1V |

Figure 11:
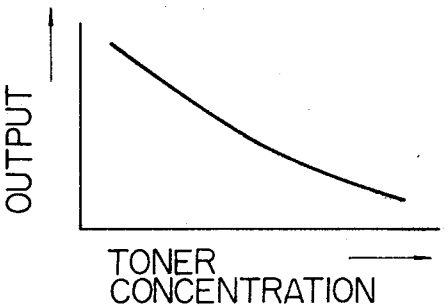
FIG. 11 is a characteristic curve for explaining the electric circuits of FIG. 10.

The added outputs are held in the condenser $C_{10}$ by the switch $S_3$ at the timing in agreement with a certain position of the gray scale. When the reference levels $V_{ref1}$ and $V_{ref2}$ of a wind comparator $A_4$ are respectively set at −0.5 V and +0.5 V and the image density of the gray scale 2 and that of the gray scale 3 are nearly the same, the light emitting diode $D_{22}$ is lit. In the case where the added output is not more than −0.5 V, the light emitting diode $D_{21}$ is lit so that it is indicated that the image density of the copied gray scale 2 is lower than that of the reference gray scale 3. Furthermore, when the added output is not less than +0.5 V, the light emitting diode $D_{23}$ is lit to indicate that the image density of the copied gray scale is higher than that of the reference gray scale 3. Referring to FIG. 11, there is shown the relationship between the output of the toner concentration detector 27 and the toner concentration, which is judged by the judgment circuit 28. The judgment level is adjusted by the judgment level adjustment circuit 32 comprising an amplifier $A_5$ and resistors $R_{32}$–$R_{36}$ correspondingly to the above-mentioned added output. To be more specific, the judgment level is adjusted in accordance with the coefficient of the relationship between the output of the toner concentration detector 27 and the toner concentration and is changed by the resistor $R_{36}$ in accordance with the output of the toner concentration detector 27. The input and output of the amplifier $A_5$ are in the non-reversible relationship. An amplifier $A_6$ makes judgment as to whether toner should be replenished or not, and the output of the toner concentration detector 27 increases when the copy image density is low, while the output of the amplifier $A_5$ decreases when the copy image density is lower than that of the reference gray scale. Therefore, these outputs are corrected with each other in the amplifier $A_6$ so that the necessity of toner replenishment is determined. In the output of the amplifier $A_6$, the low level becomes an effective signal for toner replenishment so that the light emitting diode $D_{24}$ is lit. At the time of test, the switch $S_4$ is opened and the output of the amplifier $A_3$ is measured by a voltmeter V and the switch $S_4$ is then closed, whereby the resistor $R_{39}$ is varied so that the voltmeter V indicates the same value as the above-mentioned measured value. Except at the time of test, the switch $S_4$ is closed and the output of the resistor $R_{39}$ is used instead of the hold potential of the condenser $C_{10}$.

In the apparatus shown in FIG. 2 through FIG. 4, the same members or parts as those of the apparatus shown in FIG. 8 are given the same reference numerals. The correction value indication circuit 12 comprises a plurality of wind comparators and in this case, each reference level of each wind comparator can be set at a predetermined different value.

For a convenience of explanation, the methods of detecting the toner concentration and the degree of fatigue of developer have been separately explained. However, by detecting them at the same time, the development characteristics of developer can be correctly detected and corrected. The development characteristics of developer are changed by toner concentration, charge of toner and the other factors. The charge of toner changes with time and the limit condition brings about a fatigue condition of the developer. However, it is difficult to measure each of the factors in the same copying machine. In the present invention, by the exposure detector or the photoconductor surface potential detector incorporated in the copying machine, the development characteristics are measured and evaluated in order to judge in which mode (the mode in FIG. 1 or the mode in FIG. 9) the development chacteristics are changed. In the case where the development characteristics are totally changed in the same direction as shown in FIG. 1, the toner concentration setting value is corrected while in the case where the development characteristics change as shown in FIG. 9, the development characteristics can be corrected by increasing the development bias voltage when the change is small. When the change is beyond a predetermined limit value, an indication that the time has come when the developer is to be exchanged, so that the copy image can be maintained at a predetermined quality.

What is claimed is:

1. A copy image adjustment method for correcting copy image development characteristics for use in electrophotography comprising:
   - making a first standard copy image by copying a standard original;
   - copying said first standard copy image to make a second image;
   - detecting the image density of said standard copy during the copying process thereof to produce a detecting signal corresponding to the image density; and
   - resetting the development characteristics according to the detecting signal which is produced when the image density of said standard copy is detected.

2. A copy image adjustment method for correcting copy image development characteristics as claimed in claim 1, wherein a reference gray scale is employed as said standard original and a copy gray scale is obtained by copying said reference gray scale, said method further comprising:
   - copying said copy gray scale and said reference gray scale to form said second image; detecting and comparing the image density of said copy gray scale and that of said reference gray scale during copying of said copy gray scale and said reference gray scale; determining which reference characteristic requires adjustment, and
   - resetting that development characteristic which needs adjustment in accordance with the results of the comparison.

3. A copy image adjustment method for correcting copy image characteristics as claimed in claim 1, wherein the image density of said copy gray scale and that of said reference gray scale are detected by a photoconductor surface potential detector.

4. A copy image adjustment method for correcting copy image development characteristics as claimed in claim 1, comprising the step of adjusting a correction value of toner concentration in accordance with the results of said comparison.

5. A copy image adjustment method for correcting copy image development characteristics as claimed in claim 1, comprising detecting the image density of said copy gray scale and the image density of said reference gray scale by exposure detectors.

6. A copy image adjustment method for correcting copy image development characteristics as claimed in claim 1, comprising the step of automatically adjusting a correction value of toner concentration in accordance with the results of said comparison so that the toner concentration is automatically corrected.

7. A copy image adjustment method for correcting copy image development characteristics as claimed in claim 6, comprising the steps of measuring image density characteristics at a plurality of positions of said copy gray scale from said correction value of toner concentration;

determining the change of toner concentration and fatigue by said image density characteristics; and indicating correction of a development bias voltage and change of developer in accordance with the fatigue of the developer.

8. A method of adjusting a copy image development characteristic in an electrophotographic device comprising:

making a copy of a standard original;

making a latent copy image of the standard original and the copy;

detecting the potential of a standard original portion of the latent copy image and a copy portion of the latent copy image;

comparing the potentials of each portion to each other; and adjusting the development characteristic according to the results of the comparison.

9. A method according to claim 8, wherein the standard original portion and the copy portion of the latent copy image are made simultaneously and side by side.

10. A method according to claim 8, wherein the development characteristic to be adjusted comprises the toner density of a copy image formed from a latent copy image and the adjustment comprises changing a toner concentration of the toner used to form the toner image.

* * * * *